US005330241A

United States Patent [19]

Takahashi

[11] Patent Number: 5,330,241

[45] Date of Patent: Jul. 19, 1994

[54] HAND APPARATUS

[75] Inventor: Yutaka Takahashi, Placentia, Calif.

[73] Assignee: Amada Engineering and Service Company, Inc., La Mirada, Calif.

[21] Appl. No.: 958,778

[22] Filed: Oct. 9, 1992

[51] Int. Cl.[5] ..... B66C 1/42

[52] U.S. Cl. ..... 294/86.41; 294/116; 414/744.3

[58] Field of Search ..... 294/2, 86.4, 86.41, 294/88, 115, 116; 901/30, 31, 37; 414/744.3, 744.7

[56] References Cited

U.S. PATENT DOCUMENTS

| | | | |
|---|---|---|---|
| 3,370,213 | 2/1968 | Rose | 294/115 X |
| 3,963,271 | 6/1976 | Sugino et al. | 294/88 X |
| 4,099,762 | 7/1978 | Hultdin et al. | 294/88 |
| 4,166,647 | 9/1979 | Schmidt | 294/86.41 |
| 4,372,728 | 2/1983 | Murakami | 414/744.3 X |
| 4,456,447 | 6/1984 | Smith | 294/115 X |
| 4,649,622 | 3/1987 | Scott | 294/86.4 X |
| 4,671,732 | 6/1987 | Gorman | 901/37 X |
| 4,705,311 | 11/1987 | Ragard | 294/2 |
| 5,085,556 | 2/1992 | Ohtomi | 414/744.3 |

*Primary Examiner*—Dean J. Kramer

*Attorney, Agent, or Firm*—Sandler, Greenblum & Bernstein

[57] ABSTRACT

A hand apparatus easily attaches and detaches a punch to and from a punch attaching hole of an upper turret of a turret punch press. The hand apparatus includes a vertically and horizontally movable arm, a turnable cylinder attached to an end of the movable arm, and a support cylinder disposed inside the turnable cylinder, such that the support cylinder is horizontally moved and immobilized or restrained relative to the turnable cylinder. A turnable and tiltable hand is disposed inside the support cylinder, and a clamp is disposed at a lower end of the clamp hand.

2 Claims, 2 Drawing Sheets

HAND APPARATUS

BACKGROUND OF THE INVENTION

1. Field of the Invention

The present invention relates to a hand apparatus, and particularly, to a hand apparatus for attaching and detaching a punch (an upper mold) to and from an upper turret of a turret punch press.

2. Description of the Prior Art

A turret punch press has upper and lower turrets. A block-like punch holder holding a punch (an upper mold) and a block-like die holder holding a die (a lower mold) are attached to and detached from the upper and lower turrets, to thereby replace the punch and die.

In this sort of turret punch press, the die held by the lower turret is easily replaceable by changing the die holder that is holding the die with another one. Namely, replacing a die is achievable without largely modifying the lower turret.

Replacing a punch attached to the upper turret of the turret punch press is done by upwardly pulling the punch from a punch attaching hole of the upper turret and by inserting a new punch into the punch attaching hole.

Accordingly, a great modification must be done on the upper turret if the punch holder holding a punch is required to be freely attached to and detached from the upper turret. Namely, it is not easy to attach and detach a punch to and from an existing turret punch press.

SUMMARY OF THE INVENTION

To solve the problem, an object of the present invention is to provide a hand apparatus for a turret punch press, comprising a movable arm that is vertically and horizontally movable, a turnable cylinder attached to an end of the movable arm, a support cylinder disposed inside the turnable cylinder so that the support cylinder is horizontally moved and immobilized relative to the turnable cylinder, a clamp hand disposed inside the support cylinder, and a clamp disposed at a lower end of the clamp hand. The clamp hand is turnable and tiltable relative to the support cylinder.

Another object of the invention is to provide a hand apparatus for a turret punch press, comprising a movable arm that is vertically and horizontally movable, a turnable cylinder attached to an end of the movable arm, a support cylinder disposed inside the turnable cylinder so that the support cylinder is horizontally moved and immobilized relative to the turnable cylinder, and a clamp arranged at a lower end of the support cylinder.

The clamp of the clamp hand holds upper part of a punch, to attach and detach the punch to and from a punch attaching hole of an upper turret of the turret punch press. The clamp hand is horizontally movable, turnable, and tiltable to orient the punch toward the punch attaching hole and align the axis of the punch with that of the punch attaching hole, thereby easily attaching and detaching the punch to and from the upper turret.

In this way, the invention is able to automatically attach and detach a punch to and from an existing turret punch press.

DETAILED DESCRIPTION OF THE EMBODIMENTS

Figure 1:
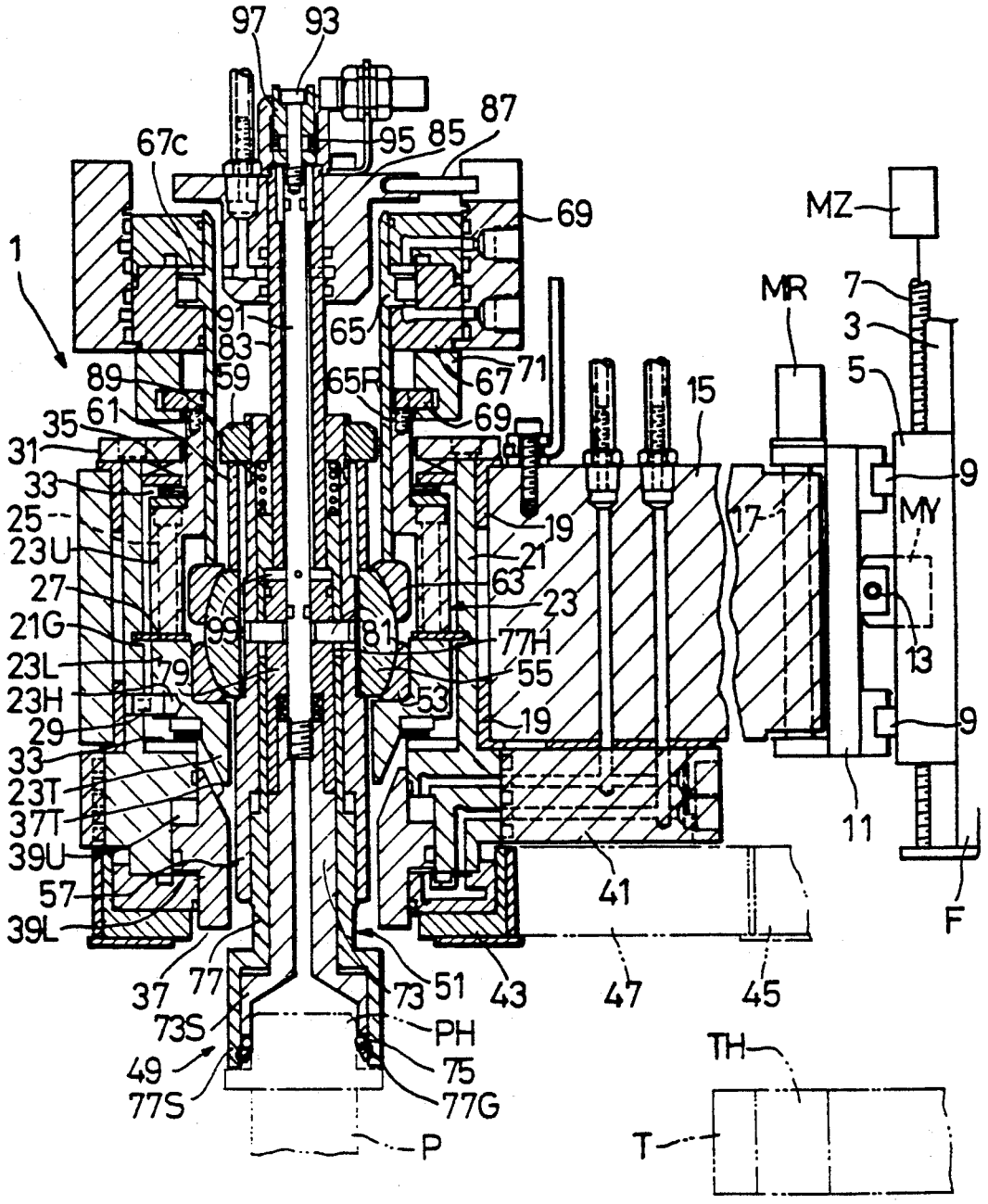
FIG. 1 is a cross-sectional view explaining essential part of a first embodiment of the invention.

FIG. 1 is a section showing a hand apparatus 1 according to the first embodiment of the invention.

A turret punch press (not shown) has an upper turret T having a punch attaching hole TH. The hand apparatus 1 is vertically movable along an upper frame F of the turret punch press, to attach and detach a punch P to and from the punch attaching hole TH.

The upper frame F has a plurality of guides 3 for vertical guiding (Z-axis guiding). Each guide 3 supports a slider 5 that is vertically movable. For vertically moving the slider 5 along the guide 3, the upper frame F has a vertical ball screw 7, which is meshed with the slider 5 and rotatable. The ball screw 7 is properly connected to a Z-axis motor MZ fitted to the upper frame F. The Z-axis motor MZ is controlled by a proper controller such as a CNC, to vertically move the slider 5.

The slider 5 has a horizontal guide 9 extending along a Y-axis extending into the plane of the paper in FIG. 1, to horizontally move the hand apparatus 1. A horizontal slider 11 is movably supported by the guide 9. The slider 5 has a Y-axis motor MY to move the horizontal slider 11. The Y-axis motor MY drives a ball screw 13, which is meshed with a nut arranged on the horizontal slider 11.

The Y-axis motor MY is properly driven by a controller, to horizontally move the horizontal slider 11 along the Y-axis relative to the vertical slider 5.

The horizontal slider 11 supports a base of a movable arm 15 through a shaft 17 such that the movable arm 15 is horizontally pivotable. For horizontally pivoting the movable arm 15, the horizontal slider 11 has a pivoting motor MR, which is properly connected to the shaft 17. Properly driving the pivoting motor MR will horizontally pivot the movable arm 15.

An end of the movable arm 15 supports a turnable cylinder 21 through a metal bearing 19 such that the turnable cylinder 21 is vertically and horizontally movable. A support cylinder 23 is supported inside the turnable cylinder 21 such that the support cylinder 23 is horizontally moved and immobilized or restrained relative to the turnable cylinder 21.

The support cylinder 23 comprises a lower support cylinder 23L and an upper support cylinder 23U. A lower end of the lower support cylinder 23L has a tapered section 23T. The upper and lower support cylinders 23U and 23L are connected to each other with a plurality of bolts 25.

A flange 27 is disposed between the upper and lower support cylinders 23U and 23L, to restrict vertical movements of the support cylinder 23. The flange 27 is horizontally movable in a groove 21G formed on the inner circumferential face of the turnable cylinder 21. A stop hole 23H is diametrally formed on the periphery of the lower support cylinder 23L, and a stop pin 29 protrudes inwardly from the inner circumferential face of the turnable cylinder 21. The stop pin 29 engages with the stop hole 23H with a relatively large clearance between them so that they are movable relative to each other. The engaging stop pin 29 and stop hole 23H always maintain the orientation of the support cylinder 23 with respect to the turnable cylinder 21.

A thrust bearing 33 is disposed between the bottom of the turnable cylinder 21 and the lower support cylinder 23L and between the upper support cylinder 23U and an annular flange 31 fixed to the top of the turnable cylinder 21, so that the support cylinder 23 may smoothly horizontally move relative to the turnable cylinder 21. A resilient member 35 is disposed between the flange 31 and the upper thrust bearing 33, to downwardly push the support cylinder 23.

Although the support cylinder 23 is restricted to move vertically with respect to the turnable cylinder 21, it is slightly movable in any horizontal direction relative to the turnable cylinder 21.

A cylindrical piston 37 is disposed under the turnable cylinder 21 and vertically movable. The piston 37 has a tapered hole 37T that engages with the tapered section 23T of the lower support cylinder 23L, to immobilize the support cylinder 23 relative to the turnable cylinder 21. A fluid coupling 41 is engaged with the lower periphery of the turnable cylinder 21 and turnable relative to the turnable cylinder 21. The fluid coupling 41 supplies a working fluid to upper and lower fluid pressure chambers 39U and 39L to vertically move the piston 37.

When the piston 37 is raised, the tapered hole 37T of the piston 37 engages with the tapered section 23T of the lower support cylinder 23L, thereby immobilizing the support cylinder 23 relative to the turnable cylinder 21.

A pulley 43 is fixed to the bottom of the turnable cylinder 21. On the other hand, a pulley 45 of the same diameter is fixed to the horizontal slider 11 (the fixed state is not shown). The pulley 45 is coaxial to the shaft 17. A belt 47 is stretched around the pulleys 43 and 45.

Accordingly, when the movable arm 15 is horizontally moved around the shaft 17, the orientation of the turnable cylinder 21 is always kept constant due to the pulleys 43 and 45 and the belt 47.

The punch P is attached to and detached from the punch attaching hole TH of the upper turret T of the turret punch press. A clamp hand 51 for holding the top of the punch P is supported by the support cylinder 23. The clamp hand 51 is rotatable and tiltable relative to the support cylinder 23. The bottom of the clamp hand 51 has a clamp 49.

A lower spherical seat 53 is disposed inside the lower support cylinder 23L of the support cylinder 23. The lower spherical seat 53 supports a pivotable support 55 having a substantially spherical shape. A cylindrical clamp holder 57 vertically passes through the center of the pivotable support 55. A lock nut 59 is screwed to an upper end of the clamp holder 57, and a sleeve 61 is interposed between the lock nut 59 and the pivotable support 55. With this arrangement, the clamp holder 57 is integrally supported by the pivotable support 55.

The bottom of a cylindrical piston rod 65R is in contact with the top of an upper spherical seat 63, which slides over the pivotable support 55. This arrangement immobilizes the pivotable support 55 as and when required. The piston rod 65R has a piston 65, which is vertically movable inside a cylinder block 67. The cylinder block 67 is integral with a support block 71, which is supported by an annular support flange 69. The flange 69 is fixed to the top of the upper support cylinder 23.

A fluid coupling 69 is engaged with the periphery of the cylinder block 67 so that the fluid coupling 69 is turnable relative to the cylinder block 67. The fluid coupling 69 supplies a working fluid to a cylinder chamber 67C of the cylinder block 67. Although not shown precisely, the fluid coupling 69 is restricted to turn relative to the movable arm 15, to always maintain the orientation of the fluid coupling 69 relative to the movable arm 15.

When the working fluid is supplied to the cylinder chamber 67C of the cylinder block 67 to lower the piston 65, the piston rod 65R strongly pushes the upper spherical seat 63 against the pivotable support 55, to thereby immobilize the pivotable support 55 between the upper and lower spherical seats 63 and 53.

When the working fluid is discharged from the cylinder chamber 67C, the pressure by the piston rod 65R is released to make the pivotable support 55 pivotable.

As explained above, the pivotable support 55 supporting the clamp hand 51 through the clamp holder 57 can be immobilized.

The clamp hand 51 comprises an inner cylinder 73 and an outer cylinder 77. A lower end of the inner cylinder 73 has a socket 73S for receiving the head PH of the punch P. A lower end of the outer cylinder 77 has an outer socket 77S for controlling movements of a plurality of clamp balls 75 relative to the socket 73S.

Upper part of the outer cylinder 77 is vertically movable inside the clamp holder 57. A fixed piston 79 is inserted in the outer cylinder 77. The fixed piston 79 is integral with the clamp holder 57 through a plurality of pins 81 that extend through vertical long holes 77H formed on the outer cylinder 77. Lower part of the fixed piston 79 properly supports upper part of the inner cylinder 73 disposed inside the outer cylinder 77.

A lower end of a connection pipe 83 passes through the ceiling of the clamp holder 57 and is connected to an upper end of the outer cylinder 77, to vertically move the outer cylinder 77 relative to the clamp holder 57. An upper end of the connection pipe 83 has a fluid coupling 85 for supplying a working fluid into the connection pipe 83. The fluid coupling 85 is supported by the fluid coupling 69 through a rotation stop member 87. The fluid couplings 85 and 69 are unturned relative to each other.

A coil spring 89 is disposed between the upper end of the outer cylinder 77 and the clamp holder 57, to downwardly push the outer cylinder 77.

The top of the inner cylinder 73 is connected to the bottom of a support lever 91. The support lever 91 passes through the fixed piston 79 and connection pipe 83. A bolt 93 is fitted to the top of the support lever 91. The bolt 93 supports a spring seat 97, which holds an elastic member 95 such as a disk spring for upwardly pushing the support lever 91 relative to the connection pipe 83.

When the fluid coupling 85 supplies a working fluid into the connection pipe 83 and into a cylinder chamber 99 between the fixed piston 79 and the outer cylinder 77, the outer cylinder 77 is raised against the coil spring 89. Namely, the outer cylinder 77 rises relative to the inner cylinder 73, so that the clamp balls 75 of the socket 73S enter into the groove 77G formed on the inner face of the outer socket 77S, to thereby release the head PH of the punch P from the socket 73S.

When the working fluid is discharged from the cylinder chamber 99, the coil spring 89 downwardly pushes the outer cylinder 77 relative to the inner cylinder 73, so that the clamp balls 75 of the socket 73S are forced to hold the head PH of the punch P engaging with the socket 73S.

To pull the punch P out of the punch attaching hole TH of the upper turret T of the turret punch press, the motors MY and MR are properly controlled to position the clamp 49 above the punch P. Then, the motor MZ is properly controlled to lower the slider 5, movable arm 15, etc., so that the punch head PH of the punch P enters the socket 73S of the clamp 49. The socket 73S then holds the head PH of the punch P. Thereafter, the slider 5, movable arm 15, etc., are raised to pull the punch P out of the punch attaching hole TH of the upper turret T.

Similarly, while the socket 73S is holding the head PH of the punch P, the socket 73S is positioned above the punch attaching hole TH of the upper turret T, and the movable arm 15, etc., are lowered. Then, the punch P whose head PH is held by the socket 73S is placed within the punch attaching hole TH.

Only a slight clearance exists between the outer diameter of the punch P and the punch attaching hole TH of the upper turret T. It is difficult, therefore, to insert the punch P into the punch attaching hole TH.

According to this embodiment, the support cylinder 23 is horizontally movably relative to the turnable cylinder 21, and the support 55 is pivotable. When inserting the punch P whose head PH is held by the socket 73S into the punch attaching hole TH of the turret T, this arrangement of the embodiment allows the support cylinder 23 to move and the pivotable support 55 to pivot if there is a slight misalignment between the lower end of the punch P and the center of the punch attaching hole TH, thereby easily engaging the punch P within the punch attaching hole TH.

When moving the punch P held by the socket 73S between, for example, the upper turret T and a punch storage (not shown), the embodiment immobilizes the support cylinder 23 and pivotable support 55 as mentioned before. Even when the turnable cylinder 21 is turned relative to the movable arm 15, the orientation of the punch P is always kept constant as mentioned before.

Figure 2:
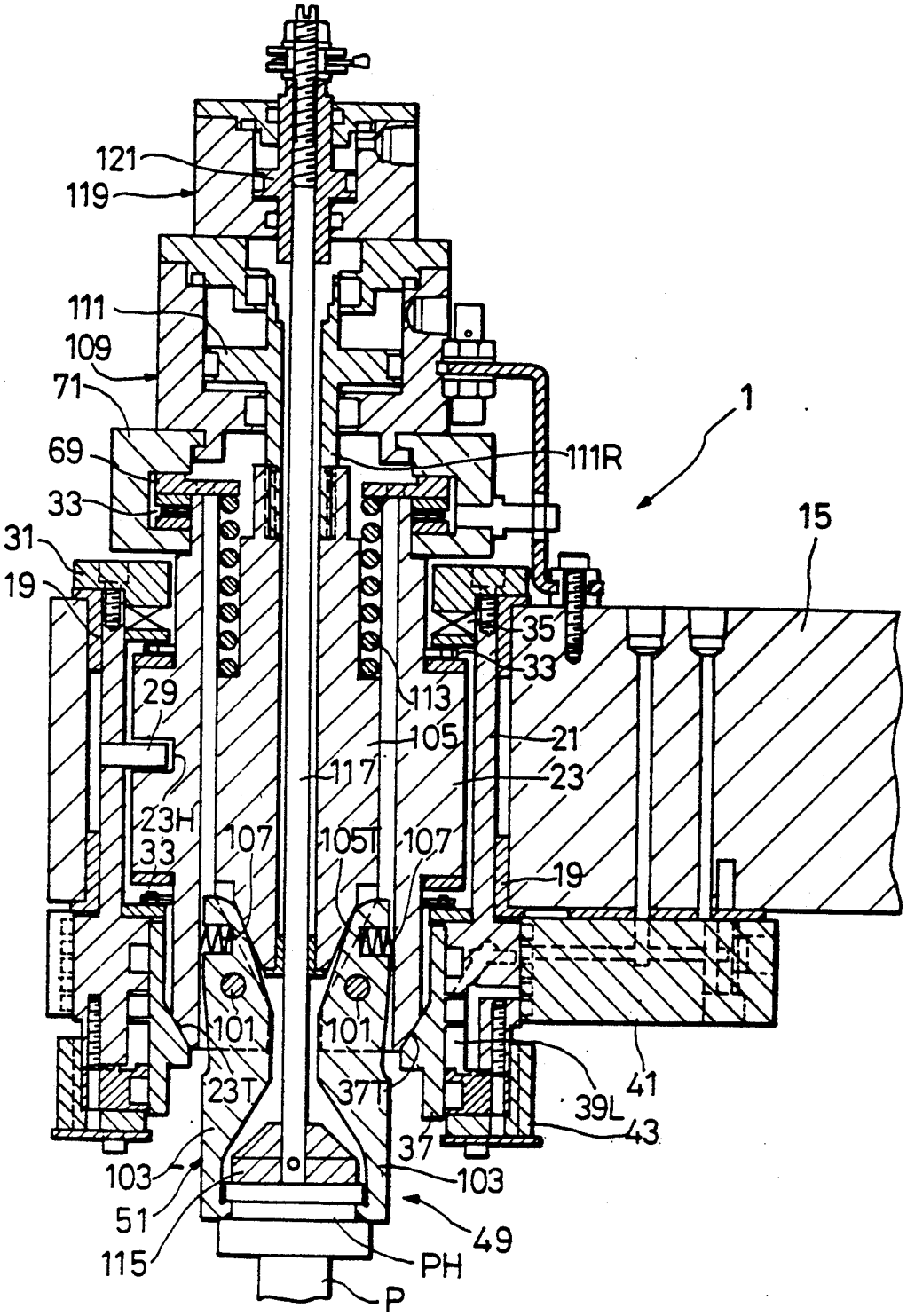
FIG. 2 is a cross-sectional view explaining essential part of a second embodiment of the invention.

FIG. 2 is a sectional view showing a hand apparatus 1 according to the second embodiment of the invention. In the figure, parts having the same structures and functions as those of FIG. 1 are represented with like numerals.

According to the second embodiment, a turnable cylinder 21 is supported at an end of a movable arm 15. A support cylinder 23 is supported inside the turnable cylinder 21 such that the support cylinder 23 is horizontally moved and immobilized relative to the turnable cylinder 21. To simplify the structure, the second embodiment arranges a clamp hand 51 having a clamp 49 under the support cylinder 23.

Below the support cylinder 23, the clamp hand 51 comprises pivotable clamp fingers 103 fitted with hinge pins 101. A clamp/unclamp driver is disposed inside the support cylinder 23, to let the clamp fingers 103 hold and release a head PH of a punch P.

A plunger 105 is vertically movable inside the support cylinder 23. A tapered portion 105T is formed at a lower end of the plunger 105. The tapered portion 105T enters into gaps formed at upper ends of the clamp fingers 103.

When the lower end of the plunger 105 is forcibly pushed under the upper ends of the clamp fingers 103, lower ends of the clamp fingers 103 hold the head PH of the punch P. when the plunger 105 is lifted, springs 107 disposed between the clamp fingers 103 and the support cylinder 23 release the punch P from the clamp fingers 103.

A vertical movement cylinder 109 is disposed at the top of the support cylinder 23, to vertically move the plunger 105 to open and close the clamp fingers 103.

A support block 71 is disposed at an upper end of the support cylinder 23. The support block 71 is turnable relative to the support cylinder 23. The orientation of the support block 71 relative to the movable arm 15 is always maintained. The support block 71 supports the cylinder 109 having a vertically movable piston 111. A piston rod 111R vertically hangs from the piston 111. A lower end of the piston rod 111R is fastened to an upper end of the plunger 105.

The cylinder 109 vertically moves the plunger 105. A coil spring 113 is interposed between the plunger 105 and a support flange 69 fitted to the upper end of the support cylinder 23, to always push down the plunger 105.

If a fluid supplying system of the cylinder 109 fails due to some reason, the coil spring 113 pushes the plunger 105 downwardly, to keep holding the punch P with the clamp fingers 103, thereby preventing an accident of releasing and dropping the punch P.

While the clamp fingers 103 are holding the head PH of the punch P, a punch presser 115 supports the top of the head PH to stabilize the punch P.

The punch presser 115 is disposed in a space defined by the clamp fingers 103, to support the head PH of the punch P. The punch presser 115 has a disk-like shape and is fitted to a lower end of a lift rod 117. The lift rod 117 vertically movably extends through the plunger 105 and the piston 111 and piston rod 111R of the cylinder 109. An upper end of the lift rod 117 is properly connected to a piston 121, which is vertically movable inside a cylinder 119. The cylinder 119 is fitted to the cylinder 109.

While the clamp fingers 103 are holding the head PH of the punch P, the cylinder 119 is driven to lower the rod 117, to bring the punch presser 115 of the rod 117 in contact with the head PH of the punch P to stabilize the punch P held by the clamp fingers 103.

Similar to the first embodiment, the second embodiment drives a Y-axis motor MY and a pivot motor MR (FIG. 1) to horizontally move the movable arm 15 so that the hand apparatus 1 disposed at an end of the movable arm 15 is positioned above a punch to be replaced in a turret of a turret punch press, or above a punch stored in a punch storage (not shown).

After the hand apparatus 1 is positioned above the punch, a Z-axis motor MZ (FIG. 1) is driven to lower the movable arm 15, to let the clamp fingers 103 hold the head PH of the punch P. Once the clamp fingers 103 hold the head of the punch P, the movable arm 15 is lifted to pull the punch upwardly out of the turret or the storage.

Similarly, when the clamp fingers 103 are holding the head PH of the punch P, the hand apparatus 1 is positioned above the punch attaching hole of the turret, and the movable arm 15 is lowered to place the punch P in the punch attaching hole.

When the movable arm 15 is horizontally moved, a piston 37 immobilizes the support cylinder 23 relative to the turnable cylinder 21. At the same time, the orientation of the turnable cylinder 21 is maintained.

When attaching and detaching the punch P to and from the punch attaching hole of the turret, the support cylinder 23 is released from the immobilized state and becomes slightly horizontally movable, so that the axial center of the support cylinder 23 may align with that of the punch attaching hole, to thereby easily fit the punch P into the punch attaching hole.

As explained above, the invention horizontally moves the movable arm 15 so that the hand apparatus 1 fitted at an end of the movable arm 15 is positioned above the punch P to be replaced and the punch attaching hole TH. Even if the axial center of the hand apparatus 1 slightly deviates from those of the punch P and punch attaching hole TH, the clamp portion of the hand apparatus 1 slightly horizontally moves to absorb the deviation, to thereby easily replace the punch P.

What is claimed is:

1. A hand apparatus comprising:

a vertically and horizontally movable arm;

a turnable cylinder attached to a free end of said movable arm;

a support cylinder disposed inside said turnable cylinder, said support cylinder being movable in a horizontal direction relative to said turnable cylinder, said support cylinder including a first tapered surface;

a means for restraining said support cylinder from moving in said horizontal direction, said restraining means being mounted on said turnable cylinder, said restraining means including a second tapered surface engageable with said first tapered surface, said second tapered surface being movable towards and away from said first tapered surface of said support cylinder;

a turnable and tiltable clamp hand disposed inside said support cylinder; and a clamp disposed at a lower end of said clamp hand.

2. A hand apparatus comprising:

a vertically and horizontally movable arm;

a turnable cylinder attached to a free end of said movable arm;

a support cylinder disposed inside said turnable cylinder, said support cylinder being movable in a horizontal direction relative to said turnable cylinder, said support cylinder including a first tapered surface;

a means for restraining said support cylinder from moving in said horizontal direction, said restraining means being mounted on said turnable cylinder, said restraining means including a second tapered surface engageable with said first tapered surface, said second tapered surface being movable towards and away from said first tapered surface of said support cylinder; and a clamp disposed at a lower end of said support cylinder.

* * * * *